US009296526B2

(12) United States Patent
Lee et al.

(10) Patent No.: US 9,296,526 B2
(45) Date of Patent: Mar. 29, 2016

(54) OPENING AND CLOSING DEVICE OF AUTOMATIC CAP FOR LIQUID VESSEL

(71) Applicants: Young Joo Lee, Anyang-si, Gyeonggi-do (KR); Jae Kwang Hwang, Seoul (KR)

(72) Inventors: Young Joo Lee, Anyang-si (KR); Hyeoung Seop Kim, Anyang-si (KR)

(73) Assignees: Young Joo Lee, Anyang-si (KR); Jae Kwang Hwang, Seoul (KR)

( * ) Notice: Subject to any disclaimer, the term of this patent is extended or adjusted under 35 U.S.C. 154(b) by 0 days.

(21) Appl. No.: 14/424,163

(22) PCT Filed: Aug. 1, 2013

(86) PCT No.: PCT/KR2013/006947
§ 371 (c)(1),
(2) Date: Feb. 26, 2015

(87) PCT Pub. No.: WO2014/035067
PCT Pub. Date: Mar. 6, 2014

(65) Prior Publication Data

US 2015/0259106 A1 Sep. 17, 2015

(30) Foreign Application Priority Data

Aug. 27, 2012 (KR) ..... 10-2012-0093536

(51) Int. Cl.
*B65D 41/00* (2006.01)
*B65D 47/20* (2006.01)

(52) U.S. Cl.
CPC ..... *B65D 41/00* (2013.01); *B65D 47/2062* (2013.01)

(58) Field of Classification Search
CPC ..... B65D 41/00
USPC ..... 220/260, 203.01; 215/307, 247; 222/107
See application file for complete search history.

(56) References Cited

U.S. PATENT DOCUMENTS

| | | | | | |
|---|---|---|---|---|---|
| 2,957,501 | A * | 10/1960 | Holmes | B65D 47/2031 141/2 |
| 3,669,323 | A * | 6/1972 | Harker | B65D 47/2031 222/490 |
| 4,177,904 | A * | 12/1979 | Puig Planas | B65D 41/00 215/12.1 |
| 2010/0072224 | A1 * | 3/2010 | Ha | B65D 35/26 222/107 |
| 2014/0151406 | A1 * | 6/2014 | Murphy | G01F 11/082 222/189.06 |

FOREIGN PATENT DOCUMENTS

| | | | |
|---|---|---|---|
| KR | 20-1998-0061202 | U | 11/1998 |
| KR | 20-0365984 | Y1 | 10/2004 |
| KR | 10-2009-0116957 | A | 11/2009 |
| KR | 10-2010-0048927 | A | 5/2010 |
| KR | 20-2011-0005954 | U | 6/2011 |

* cited by examiner

*Primary Examiner* — King M Chu
(74) *Attorney, Agent, or Firm* — Novick, Kim & Lee, PLLC; Jae Youn Kim

(57) ABSTRACT

The present invention relates to an opening and closing device for an automatic cap for a liquid container, which includes a container (10), a cap (20) which is screwed onto the inlet portion of the container (10), and an opening and closing member (30) which is disposed in the container (10) through the cap (20) and the inlet portion of the container (10) such that, when the container (10) is pressed from the outside, the container (10) can remain closed while contents are discharged. According to the present invention, the contents in the container can be automatically discharged and the container can be closed without removing the cap which is the lid of the container; the cap can be conveniently sealed so that the contents do not leak out even when the container is pressed during shipping or during transport for travel; and during use, the contents can be automatically discharged and the container remain closed just by pressing the container after releasing the seal.

1 Claim, 5 Drawing Sheets

OPENING AND CLOSING DEVICE OF AUTOMATIC CAP FOR LIQUID VESSEL

CROSS-REFERENCE(S) TO RELATED APPLICATION

This application claims under 35 U.S.C. §119(a) the benefit of Korean Patent Application No. 10-2012-0093536 filed on Aug. 27, 2012, the entire contents of which are incorporated herein by reference.

BACKGROUND (a) Field of the Invention

The present invention relates to an opening and closing device of an automatic cap for a liquid vessel, and more particularly, to an opening and closing device of an automatic cap for a liquid vessel capable of extracting its contents by pressing the vessel without opening or removing a cap which is a lid of the vessel and capable of closing the vessel automatically when the vessel is not pressed.

(b) Background Art

In general, a common vessel which is used by inserting aqueous contents such as cosmetics or kitchen detergents has a vessel cap that is snap-hinged integrally or combined detachably as a separate structure to a neck part of a vessel body thorough which an outlet is penetrated.

Accordingly, in case of extracting its contents from a vessel body, the contents is extracted by opening an outlet of a vessel body while pulling and separating integrated vessel cap which is snap-hinged to a neck part of a vessel body or by opening the outlet of a vessel body while rotating or drawing the vessel cap provided as a separate structure which is combined to the neck part of a vessel body detachably.

However, in such a vessel, the outlet of a vessel body to extract its contents could be opened only when the vessel cap is separated from a neck part of a vessel body necessarily, and there is some inconvenience in turning a vessel body upside down or tilting it at certain angle necessarily when extracting its contents from a vessel body.

SUMMARY OF THE DISCLOSURE

The present invention has been proposed to solve the problems described in the forgoing and an object of the present invention is to provide an opening and closing device of an automatic cap for a liquid vessel capable of extracting its contents by pressing the vessel without opening or removing a cap which is a lid of the vessel and capable of being closed automatically when the vessel is not pressed.

According to a first embodiment of the present invention, an opening and closing device of an automatic cap for a liquid vessel may be provided with: a vessel (10), a cap (20) which is screwed with an inlet part of the vessel (10); and an opening and closing member (30) installed within the vessel (10) between the cap (20) and the inlet part of the vessel (10) for extracting and closing the contents when pressing the vessel (10) from an outside.

Here, the opening and closing member (30) in a cylindrical shape an upper part and a lower part of which are opened may include: a rotation opening and closing member (31) provided with a cylindrical rotation part (31*a*) that is protruded from a lower part toward a top surface to be inserted into a central hole (21) of the cap (20), a flange part (31*b*) that is formed integrally on a lower part of the cylindrical rotation part (31*a*) in a larger diameter than the cylindrical rotation part and seated on an inner peripheral surface of a lower part of the cap (20), a pair of projection plates (31*c*) that are protruded symmetrically and vertically on both sides of an inner peripheral surface of the cylindrical rotation part (31*a*), and a liquid discharging hole (31*d*) that is formed on a center of an upper surface of the cylindrical rotation part (31*a*); an up-down movement bar member (31) in a bar shape, provided with two projection bars (32*a*) which are protruded as a pair on both sides of an upper part thereof and into which the pair of the projection plates (31*c*) of the rotation opening and closing member (31) are inserted such that the up-down movement bar member is rotated according to the rotation of the rotation opening and closing member (31), a pair of lower end projection bars (32*b*) that are protruded toward both sides at a lower end thereof wherein they are protruded at the same direction as the two projection bars (32*a*), a pair of lower side projection bars (32*d*) which are protruded toward both sides at a lower side thereof and at ends of which the circular plates (32*c*) are formed, respectively, and a circular outer peripheral groove (32*e*) that is formed right above the lower end projection bar (32*b*); and a vessel inner member (33) provided with a circular part (33*b*) into which an upper end of the up-down movement bar member (32) is inserted through an upper hole (33*a*) formed at a center thereof and which is inserted between the cap (20) and the vessel (10), a band type-member (33*c*) that is formed in an U shape on both sides of a lower part of the circular part (33*b*), a lower slit hole (33*d*) which is formed at a center of most-lower surface of the band-shape member (33*c*) and into which the lower end projection bar (32*b*) of the up-down movement bar member (32) is inserted, and an inner side projection bar (33*f*) at an end of which an inner side circular plate (33*e*) is formed to be engaged with the circular plate (32*c*) of the up-down movement bar member (32).

BRIEF DESCRIPTION OF THE DRAWINGS

The above and other aspects, features and advantages of certain exemplary embodiments of the present invention will be more apparent from the following description taken in conjunction with the accompanying drawings, in which.

DETAILED DESCRIPTION

Figure 1:
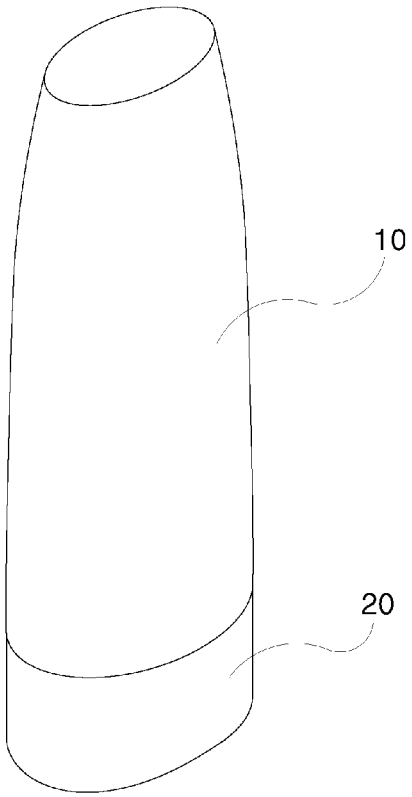
FIG. 1 is a perspective view showing a liquid vessel of the present invention.

Exemplary embodiments of the present invention will be described below in detail with reference to the accompanying drawings. Wherever possible, the same reference numerals will be used to refer to the same elements throughout the specification, and a duplicated description thereof will be omitted. It will be understood that although the terms "first", "second", etc. are used herein to describe various elements, these elements should not be limited by these terms. These terms are only used to distinguish one element from another element.

[Embodiment]

Figure 2:
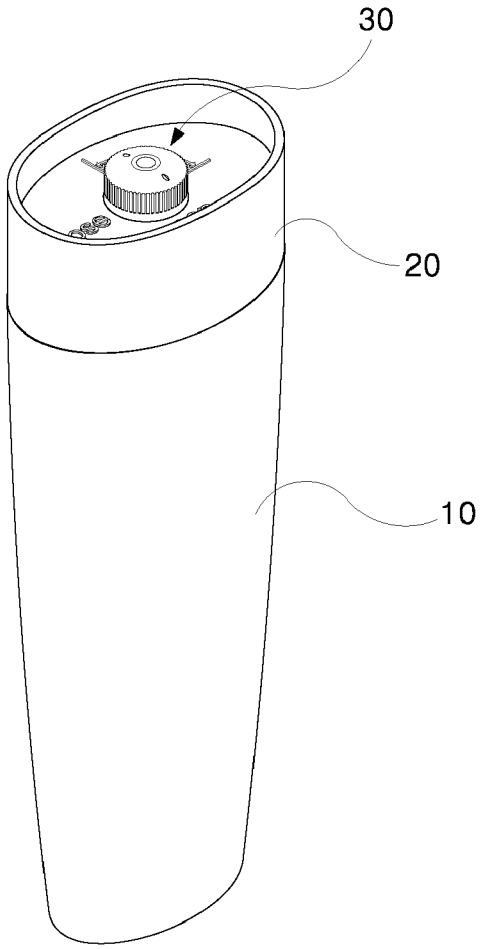
FIG. 2 is a perspective view showing a cap part of a liquid vessel of the present invention.
Figure 3:
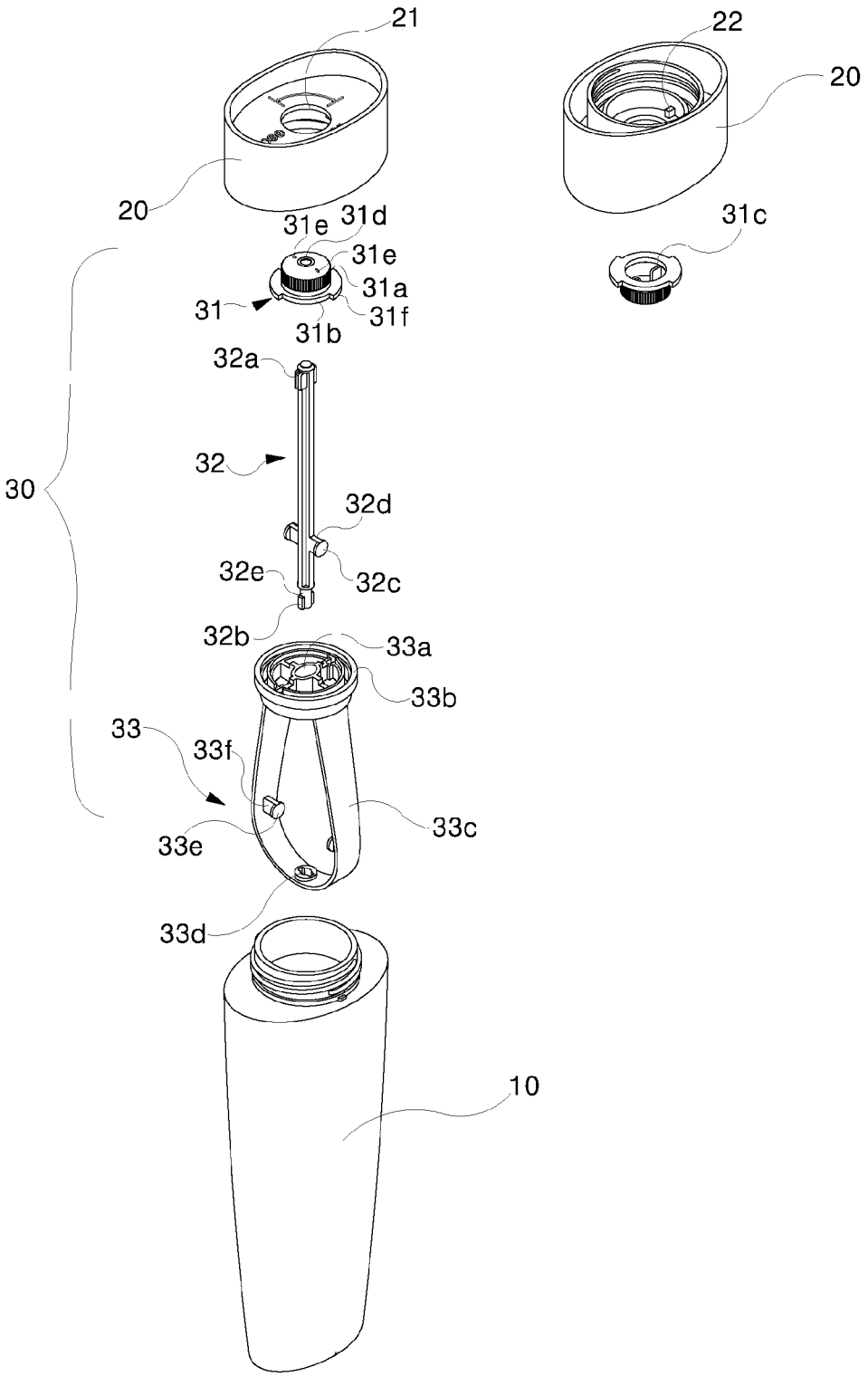
FIG. 3 is an exploded perspective view showing a cap and an extracting member of a liquid vessel of the present invention.
Figure 4:
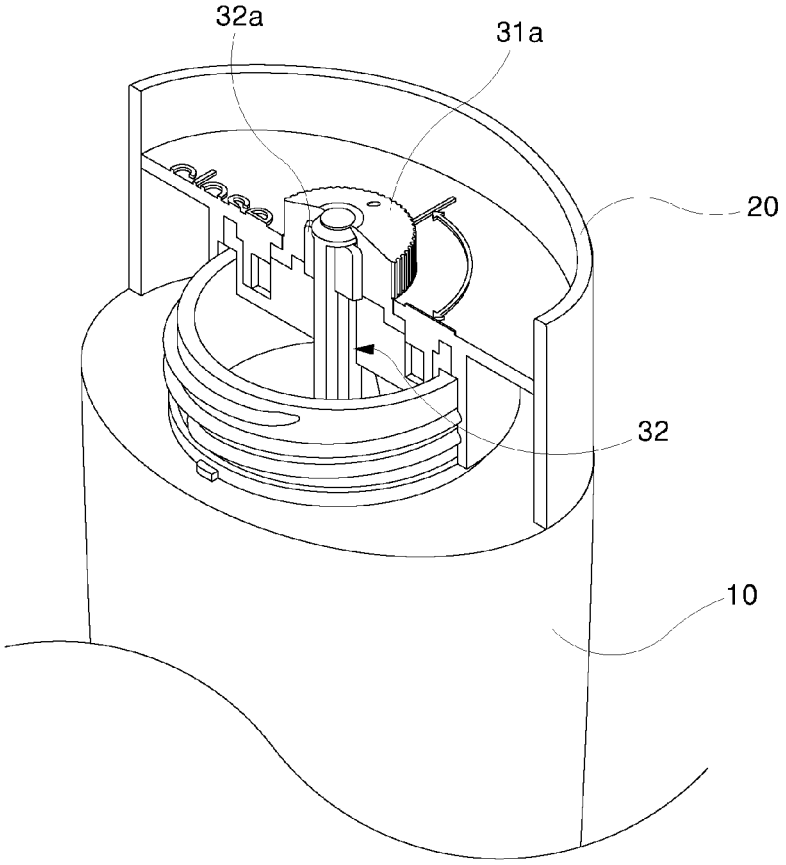
FIG. 4 is a partial cross sectional view showing a cap part of a liquid vessel of the present invention.
Figure 5:
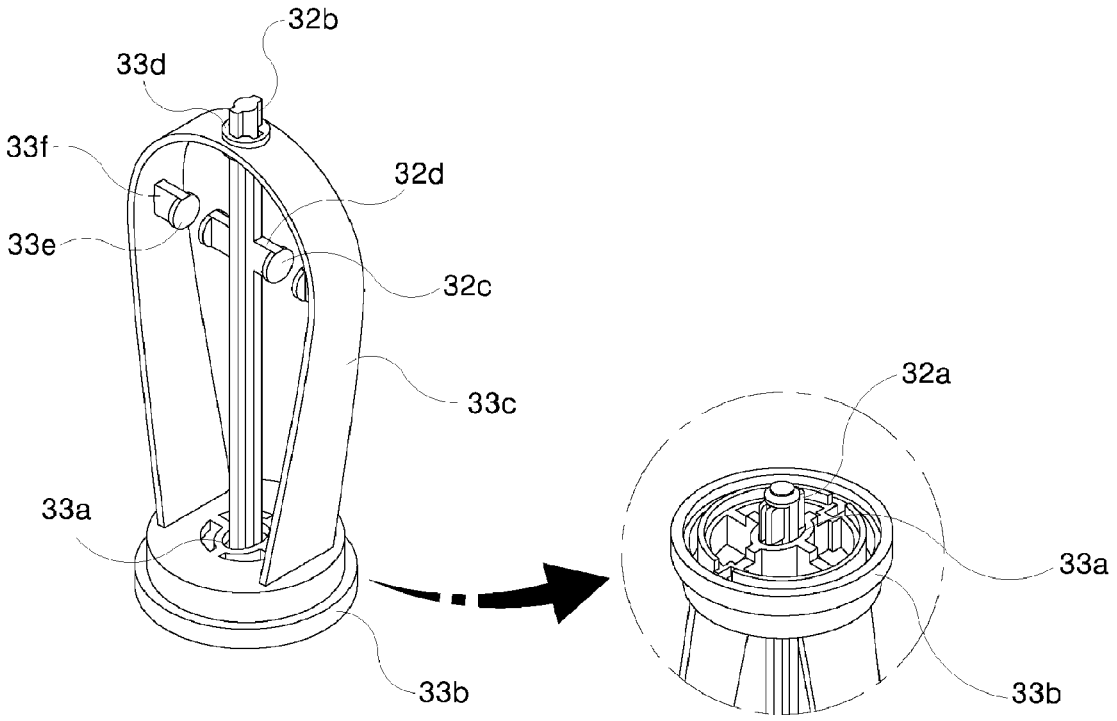
FIG. 5 is an assembly perspective view showing a condition wherein a cap of a liquid vessel of the present invention is closed.

FIG. 1 is a perspective view showing a liquid vessel of the present invention, FIG. 2 is a perspective view showing a cap part of a liquid vessel of the present invention, FIG. 3 is an exploded perspective view showing a cap and an extracting member of a liquid vessel of the present invention, FIG. 4 is a partial cross sectional view showing a cap part of a liquid vessel of the present invention, and FIG. 5 is an assembly perspective view showing a condition wherein a cap of a liquid vessel of the present invention is closed.

As shown in FIGS. 1 to 5, an opening and closing device of an automatic cap for a liquid vessel according to the present invention may include; a vessel 10, a cap 20 which is screwed with an inlet part of the vessel 10; and an opening and closing member 30 installed within the vessel 10 between the cap 20 and the inlet part of the vessel 10 for extracting and closing the contents when pressing the vessel 10 from an outside.

The opening and closing member 30 in a cylindrical shape an upper part and a lower part of which are opened may include: a rotation opening and closing member 31 provided with a cylindrical rotation part 31*a* that is protruded from a lower part toward a top surface to be inserted into a central hole 21 of the cap 20, a flange part 31*b* that is formed integrally on a lower part of the cylindrical rotation part 31*a* in a larger diameter than the cylindrical rotation part and seated on an inner peripheral surface of a lower part of the cap 20, a pair of projection plates 31*c* that are protruded symmetrically and vertically on both sides of an inner peripheral surface of the cylindrical rotation part 31*a*, and a liquid discharging hole 31*d* that is formed on a center of an upper surface of the cylindrical rotation part 31*a*; an up-down movement bar member 31 in a bar shape, provided with two projection bars 32*a* which are protruded as a pair on both sides of an upper part thereof and into which the pair of the projection plates 31*c* of the rotation opening and closing member 31 are inserted such that the up-down movement bar member is rotated according to the rotation of the rotation opening and closing member 31, a pair of lower end projection bars 32*b* that are protruded toward both sides at a lower end thereof wherein they are protruded at the same direction as the two projection bars 32*a*, a pair of lower side projection bars 32*d* which are protruded toward both sides at a lower side thereof and at ends of which the circular plates 32*c* are formed, respectively, and a circular outer peripheral groove 32*e* that is formed right above the lower end projection bar 32*b*; and a vessel inner member 33 provided with a circular part 33*b* into which an upper end of the up-down movement bar member 32 is inserted through an upper hole 33*a* formed at a center thereof and which is inserted between the cap 20 and the vessel 10, a band type-member 33*c* that is formed in an U shape on both sides of a lower part of the circular part 33*b*, a lower slit hole 33*d* which is formed at a center of most-lower surface of the band-shape member 33*c* and into which the lower end projection bar 32*b* of the up-down movement bar member 32 is inserted, and an inner side projection bar 33*f* at an end of which an inner side circular plate 33*e* is formed to be engaged with the circular plate 32*c* of the up-down movement bar member 32.

Here, the outer peripheral projections 31*f* that are protruded symmetrically each other on a side of the flange part 31*b* of the rotation opening and closing member 31 such that the circular rotation part 31*a* is caught over the inner peripheral surface projections for a cap 22 that are produced symmetrically on an inner peripheral surface of the cap 20 when the circular rotation part is rotated thereby to restrict the rotation angle.

Next, the operation and effects of the present invention will be described.

Firstly, when the assembly procedure of the opening and closing member 30 that is installed between the vessel 10 and the cap 20 that are screwed with each other is described, the cylindrical rotation part 31*a* of the rotation opening and closing member 31 is inserted into a hole formed at the center of the cap 20 through an inner side of the cap 20, and two projection plates 31*c* of the rotation opening and closing member 31 are inserted between two projection bars 32*a* that are protruded as a pair on both sides of an upper end of the up-down movement bar member 32 through a lower part of the rotation opening and closing member 31 while an upper end of the up-down movement bar member 32 is inserted through a lower part of the upper hole 33*a* of the vessel interior member 33.

Further, the lower end projection bars 32*b* of the up-down movement bar member 32 is rotated after passing entirely through the lower slit hole 33*d* of the band type-member 33*c*, the lower slit hole 33*d* of the band type-member 33*c* is caught over the circular outer peripheral groove 32*e* of the up-down movement bar member 32.

Further, the band type-member 33*c* of the vessel interior member 33 is inserted into the inside of the vessel 10 and the vessel 10 and the cap 20 are screwed, thereby completing the assembly.

Such a state of assemblage is a closed state; when a display part 31*e* of the rotation opening and closing member is at Close position, the lower end projection 32*b* of the up-down movement bar member 32 is disposed at a lower surface of the lower slit hole 33*d* of the band shaped-member 33*c*, the lower slit hole 33*d* of the band shaped-member 33*c* is caught over the circular outer peripheral groove 32*e*, and the circular plate 32*c* of the lower side projection bar 32*d* is engaged with the inner circular plate 33*e* of the inner side projection bar 33*f* which is protruded on inner side surface of the band shaped-member 33*c* such that the band shaped-member 33*c* will not be pursed up even if the vessel 10 is pressed externally (see FIG. 5).

In order to open the vessel in such a state, when the circular rotation part 31*a* which is protruded to an upper part of a cap 20 is rotated in an opening direction, the up-down movement bar member 32 which is engaged with two projection plates 31*c* on an inner peripheral surface of the rotation extraction member 31 rotates, thereby the circular plate 32*c* of the lower side projection bar 32*d* and inner side circular plate 33*e* of the inner side projection bar 33*f* that is produced on an inner surface of the band type-member 33*c* are disengaged. As the circular plate 32*c* and the inner side circular plate 33*e* are disengaged from each other likewise, when a vessel 10 is pressed externally, the band type-member 33*c* is contracted forcing the up-down movement bar member 32 to move downwardly and when a pressed condition of the vessel 10 is relieved, the up-down movement bar member is lifted upwardly again to close the liquid extracting hole 31*d* at the same time while the contents of the vessel 10 is extracted to the a liquid extracting hole 31*d* of the rotation extraction member 31.

According to the opening and closing device of an automatic cap for a liquid vessel of the present invention, its contents can be extracted from a vessel without removing a cap which is a lid of the vessel and can be closed, and the cap conveniently can be sealed so that the contents may not leak even if the vessel is pressed in the distribution channel or on a journey, and the contents can be extracted automatically by simply pressing the vessel with unsealing the vessel and be closed at usage.

While the invention has been shown and described with reference to exemplary embodiments thereof, it will be understood by those skilled in the art that various changes in form and details may be made therein without departing from the spirit and scope of the invention as defined by the appended claims. Therefore, the scope of the invention is defined not by the detailed description of the invention but by the appended claims, and all differences within the scope will be construed as being included in the present invention.

What is claimed is:

1. An opening and closing device of an automatic cap for a liquid vessel comprising:

a vessel;

a cap which is screwed with an inlet part of the vessel and includes a central hole; and an opening and closing member installed within the vessel between the cap and the inlet part of the vessel for extracting contents when pressing the vessel from outside, wherein the opening and closing member comprises:

a rotation opening and closing member including a lower part, a top surface, a cylindrical rotation part that is protruded from the lower part toward the top surface, such that the cylindrical rotation part is configured to be inserted into the central hole of the cap, the lower part including a flange part that has a larger diameter than the cylindrical rotation part and is configured to be seated on an inner peripheral surface of a lower portion of the cap, a pair of projection plates that are protruded symmetrically and vertically on both sides of an inner peripheral surface of the cylindrical rotation part, and a liquid discharging hole that is disposed on the top upper surface;

an up-down movement bar member in a bar shape, including two upper end projection bars which are protruded as a pair on both sides of an upper part thereof, a pair of gaps disposed on each side of the upper part and defined by the pair of two upper end projection bars, wherein the pair of the projection plates of the rotation opening and closing member are inserted into the pair of the gaps respectively such that the up-down movement bar member is rotated according to the rotation of the rotation opening and closing member, a pair of lower end projection bars that are protruded at a lower end of the up-down movement bar member in a same direction as the two upper end projection bars, a pair of lower side projection bars which are protruded toward outside from a lower side surface of the up-down movement bar member and have circular plates disposed at an end of each of the pair of lower side projection bars, respectively, and a circular outer peripheral groove that is formed above the pair of lower end projection bar; and a vessel inner member including a circular part into which an upper end of the up-down movement bar member is inserted through an upper hole disposed at a center of the vessel inner member, the circular part being disposed between the cap and the vessel, a band type-member having a U shape and connected to a lower portion of the circular part, a lower slit hole disposed at a center of a lower end surface of the band-shape member and into which the lower end projection bar of the up-down movement bar member is inserted, and an inner side projection bar having an inner side circular plate configured to engage with one of the circular plates of the up-down movement bar member.

* * * * *